US005589091A

United States Patent [19]

Müller

[11] Patent Number: 5,589,091

[45] Date of Patent: Dec. 31, 1996

[54] GLOW PLUG WITH PRESTRESSED CONTACT SURFACES

[75] Inventor: Helmut Müller, Besigheim-Ottmarsheim, Germany

[73] Assignee: BERU Ruprecht GmbH & Co. KG, Germany

[21] Appl. No.: 325,950

[22] Filed: Oct. 17, 1994

[30] Foreign Application Priority Data

Oct. 15, 1993 [DE] Germany ..... 43 35 292.8

[51] Int. Cl.[6] ..... F23Q 7/00; H05B 3/10

[52] U.S. Cl. ..... 219/270; 123/145 A; 219/541; 361/266

[58] Field of Search ..... 219/260–270, 219/541; 123/145 A; 361/264–266

[56] References Cited

U.S. PATENT DOCUMENTS

| | | | |
|---|---|---|---|
| 4,312,120 | 1/1982 | Comer | 29/611 |
| 4,418,661 | 12/1983 | Esper et al. | 123/145 A |
| 4,582,981 | 4/1986 | Brooks et al. . | |
| 5,084,607 | 1/1992 | Shafer et al. | 219/270 |
| 5,172,664 | 12/1992 | Mueller et al. | 123/145 A |

FOREIGN PATENT DOCUMENTS

| | | | |
|---|---|---|---|
| 0194535 | 9/1986 | European Pat. Off. . | |
| 2398969 | 3/1979 | France | 219/270 |
| 1213669 | 3/1966 | Germany | 123/145 A |
| 3146653 | 11/1981 | Germany . | |
| 3701929 | 1/1987 | Germany . | |
| 3707814 | 3/1987 | Germany . | |
| 3802233 | 1/1988 | Germany . | |
| 4133046 | 4/1992 | Germany . | |
| 4203183 | 8/1992 | Germany . | |
| 611659 | 10/1960 | Italy | 361/264 |
| 58-72821 | 4/1983 | Japan | 123/145 A |
| 2092670 | 8/1982 | United Kingdom . | |

*Primary Examiner*—John A. Jeffery

*Attorney, Agent, or Firm*—Sixbey, Friedman, Leedom & Ferguson, P.C.; David S. Safran

[57] ABSTRACT

Glow plug with a metallic hollow body 1 in which a ceramic heating rod 2 is arranged such that it projects axially on one side of hollow body 1. The heating rod 2 is formed of a ceramic conductor 6 which is embedded in a ceramic insulator 7 and is connected to the power supply terminals, i.e., to ground via the metal of hollow body 1 and via a plug terminal 3. The contacts of the ceramic conductor 6 with the power supply terminals are formed by contact surfaces 8, 9 on the ceramic conductor 6, via which the conductor is in contact, on the one hand, with metallic hollow body 1, and with plug terminal 3, on the other hand. The contacts are preferably pressure loaded by generating a prestress between the components in contact. Preferably, metallic contact parts, for example, contact rings 10, 11, are provided at the contact points between the contact surfaces 8, 9 and the metallic hollow body 1 and plug terminal 3.

19 Claims, 3 Drawing Sheets

GLOW PLUG WITH PRESTRESSED CONTACT SURFACES

BACKGROUND OF THE INVENTION

1. Field of the Invention

The invention relates to a glow plug with a hollow body in which a ceramic heating rod with a sintered-in heating element is located, which projects axially on one side of the hollow body and which has a heating element which is connected to power supply terminals.

2. Description of Related Art

Glow plugs of the initially mentioned type are known which have a ceramic conductor and a metal resistance spiral as the heating element (German Patent Application Nos. 42 03 183 A1 and 41 33 046 A1).

Glow plugs are generally used as a starting aid in diesel engines and alcohol-fueled engines, for ignition of accessory heating plants, for igniting gas burners, etc.

In German Patent Application No. 42 03 183 A1, the ceramic conductor of the disclosed glow plugs consists of a conductor piece that is U-shaped and which is located in the front end of the projecting part of the heating element and forms a first heating element. This first heating element is connected to the power supply terminals via a second heating element in the form of a spiral made of metallic material.

The glow plug of German Patent Application No. 41 33 046 A1 has the heating spiral is connected directly to the power supply terminals.

Based on the bonding provided in glow plugs of this type in the heating area, especially between the first and the second heating elements, and between the second heating element and the power supply terminals, the process by which these glow plugs are produced is very complicated. Due to the necessary bonding in the heating area, them is, moreover, a thermal loading limit of the ceramic conductor sintered into the ceramic insulator is roughly 1200° C.

SUMMARY OF THE INVENTION

The problem of the invention, conversely, is to obtain glow plugs of the type mentioned initially, such that they can be produced with a simple production process which comprises a smaller number of production steps, using few individual parts, and in which thermal overloading on the contact points is avoided.

This problem is solved according to the invention by forming contact surfaces on the heating element via which the heating element is in contact with the power supply terminals.

In the design according to the invention, contacts, especially soldering contacts, are avoided in the heating area, so that no thermal overloads can occur on the contact points, and with the contacts being in the form of contact surfaces on the heating element, the glow plug according to the invention can be produced with a simple process.

Based on the design according to the invention, moreover, it is possible to impart dimensions to the glow plug which correspond geometrically to metal rod glow plugs, i.e., to achieve a ceramic glow plug in a compact design which can be mass-produced with existing known production processes, i.e., cost-favorably. The glow plug according to the invention has a heating element which is stable, both thermally and mechanically, even at temperatures of more than 1200° C.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
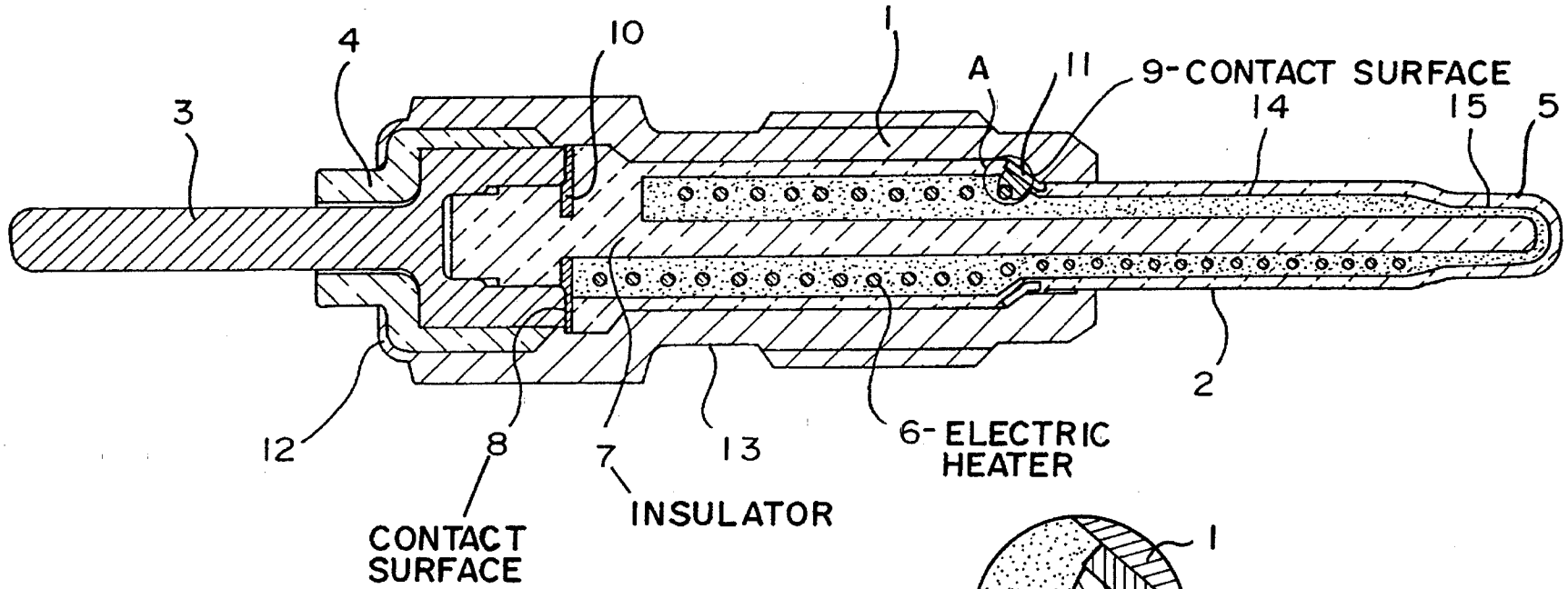
FIG. 1 shows an axial cross-sectional view of a first embodiment of the glow plug according to the invention.
Figure 1A:
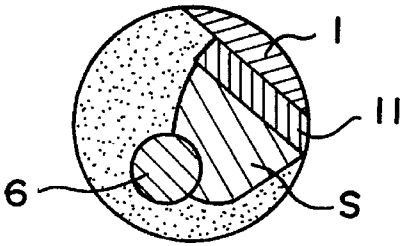
FIG. 1A is an enlarged view of the encircled detail A of FIG. 1, showing the connection between the embedded electric heating element and the contact element at the external surface of the heater rod body.

The glow plug shown in FIG. 1 essentially is formed of a metal hollow body 1 having an internal cavity in which a ceramic heating rod 2 is mounted with one end thereof, i.e., the end to be mounted in the engine, projecting axially from the hollow body 1. Heating rod 2 is essentially composed of a ceramic insulator 7, for example, made of AlN, in which a ceramic conductor 6, for example made of SiC or SiAlON, is embedded, for example, sintered. Ceramic conductor 6 is constructed to have a zone 15 of higher electrical resistance formed in the tip of the projecting end of the heating rod, i.e., in heating area 5. This zone 15 forms the actual heating resistance which preferably is U-shape in the manner shown in FIG. 1. This shaping can be achieved by a corresponding doping of ceramic conductor 6 in zone 15 or by a reduction of the cross section.

Zone 15 is adjoined by low resistance area 14 which electrically connects the two ends of the heating resistance to the terminal area, i.e., the power supply terminals which, in the embodiment of the metal hollow body 1 shown in FIG. 1, are a ground, screw or plug terminal 3 which is, likewise, mounted in the end of the hollow body 1 opposite that from which the portion of the ceramic heating rod 2 having the heating area 5 projects.

To form heating rod 2, ceramic conductor 6 is sintered into ceramic insulator 7 using conventional production processes, and by mechanical working before or after the sintering process, heating rod 2 is provided with contact surfaces 8 and 9 for the ground contact and the plug contact. The arrangement of ceramic conductor 6 and formation of the contact surfaces 8 and 9 are such that ceramic conductor 6 is electrically connected, on the one hand, to the metal hollow body 1 at one end section for forming the ground contact, and on the other hand, to the plug terminal 3 at the other end section. Ground contact surface 9 can, at the same time, be used as a seal seat. Contact surface 8 is connected to plug terminal 3 which, for example, can be formed as a round plug.

Bonding of ceramic conductor 6 to the power supply terminals, i.e., according to FIG. 1 to metal hollow body 1 and to plug terminal 3, is preferably achieved by pressure bonding. This means that the contact is pressed on contact surfaces 8 and 9. This can be achieved by installing heating rod 2 in a pressure-tight manner in hollow body 1 by crimping edge 12 of hollow body 1 onto insulating ring 4, the prestress achieved thereby resulting in a pressure on contact surfaces 8 and 9. The prestress can, moreover, be attained or increased by heating and axial upsetting of hollow body 1 in middle area 13.

If it should be necessary, the contacts can, additionally, be soldered or cemented with a conductive cement or conductive putty.

In the glow plug shown in FIG. 1, to improve bonding on contact surfaces 8 and 9, contact parts in the form of metallic contact rings 10 and 11 are provided which are mechanically and electrically connected, for example, by soldering, to ceramic conductor 6 on contact surfaces 8 and 9. These contact rings 10 and 11 can be applied to the prefabricated heating rod 2 or can be connected to ceramic conductor 6 before the ceramic conductor, with contact rings 10, 11, is sintered completely into ceramic insulator 7. The corresponding arrangement of ceramic conductor 6 and contact rings 10, 11 in insulator 7 provides for ceramic conductor 6 being electrically insulated on points diametrically opposite the points of contact against hollow body 1 or plug terminal 3.

Figure 2:
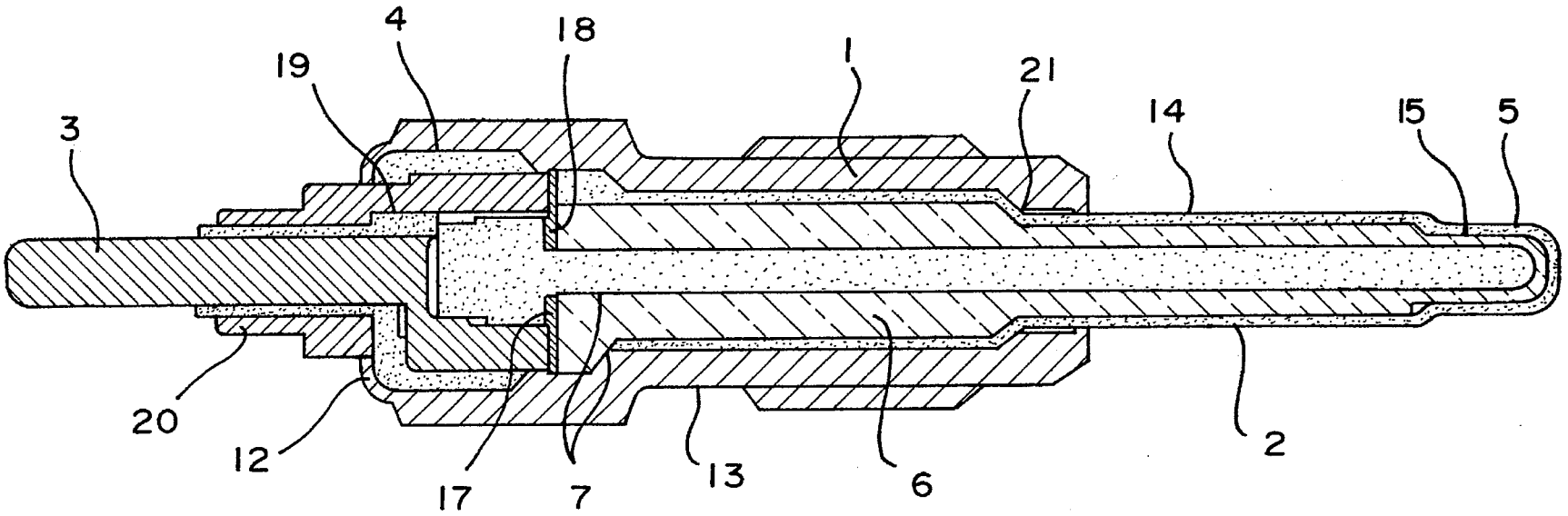
FIG. 2 shows an axial cross-sectional view of a second embodiment of the glow plug according to the invention.

FIG. 2 shows an embodiment of the glow plug according to the invention which differs from the embodiment shown in FIG. 1 by the fact that it is a two-pole version as compared to the single-pole version shown in FIG. 1.

While in the embodiment shown in FIG. 1 contact surface 9 for the ground contact was formed with metallic hollow body 1 on an outer side of ceramic conductor 6 in the low-resistance area, in the embodiment shown in FIG. 2, the contact surface for forming the ground contact is provided on an end of ceramic conductor 6 and is connected via contact part 18 to second pole 20 of plug terminal 3; its first pole is formed in the same way as in the embodiment of FIG. 1. Insulating part 19 is provided between the two poles 3 and 20 of plug terminal 3.

While in the embodiment shown in FIG. 1 the contact parts were formed as contact rings 10, 11, in the embodiment shown in FIG. 2 individual contact tips 17, 18 are provided which are each located or formed for contacting only the corresponding first or second pole.

In a two-pole formation, as is shown in FIG. 2, hollow body 1 is electrically insulated relative to the heating elements by surface 21 at the point on which, in FIG. 1, ground contact surface 9 is formed.

Otherwise, the glow plug shown in FIG. 2 corresponds to the structure described already in conjunction with FIG. 1.

In the embodiments shown in FIGS. 1 and 2, special doping of the conductive ceramic of ceramic conductor 6 makes ceramic conductor 6 with areas having different temperature coefficients of resistance, i.e., for an area with a positive temperature coefficient of resistance being formed so that the glow plug is self-regulating. This self-regulation property can be provided over the entire area of ceramic conductor 6 or only over a partial area. Preferably this property is present over area 14.

Figure 3:
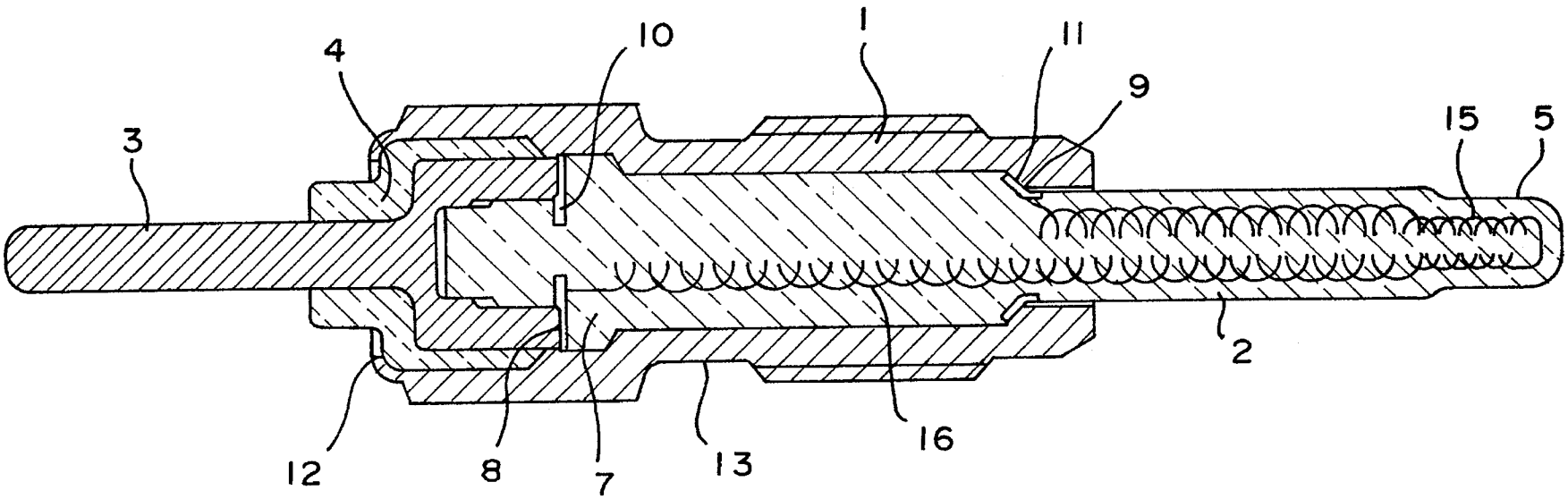
FIG. 3 shows an axial cross-sectional view of a third embodiment of the glow plug according to the invention.

The third embodiment, shown in FIG. 3, differs from the embodiment shown in FIG. 1, essentially, by the fact that, instead of a ceramic conductor as the heating element, a heating spiral 16 made of resistance wire, especially a tungsten wire spiral, is provided. Tungsten wire spiral 15 is sintered into ceramic insulator 7 and is connected via contact rings 10, 11 to the supply terminals, for example plug terminal 3 and the ground terminal on body 1 on contact surface 9. Otherwise, the third embodiment of FIG. 3 corresponds to the first embodiment described using FIG. 1.

I claim:

1. Glow plug comprising a hollow body in which a ceramic heating rod, having a rod body formed entirely of sintered ceramic material, is disposed with the heating rod axially projecting from a first end of the hollow body; wherein a sintered-in heating element is embedded within the sintered ceramic material of the unitary rod body so as to be fully enclosed by said sintered ceramic material, and wherein the sintered-in heating element is directly connected to power supply terminals by pressure contact therewith via contact surfaces integrally joined with the ceramic material of the rod body at an external surface of the rod body.

2. Glow plug according to claim 1, wherein the contact surfaces of the heating element are pressure-applied onto the power supply terminals.

3. Glow plug according to claim 2, wherein an insulating and sealing ring is located in a second end of the hollow body that is opposite said first end and an edge of the hollow body having been crimped on to the insulating and sealing ring in a manner creating a prestress in an axial direction which applies pressure at the contact surfaces.

4. Glow plug according to claim 2, wherein the hollow body has been heated and axially upset in a manner creating an axial prestress which places contact surfaces under pressure.

5. Glow plug according to claim 1, wherein metallic contact surfaces are provided at contact points between the contact surfaces of heating element and the power supply terminals.

6. Glow plug according to claim 1, wherein the power supply terminals comprise a plug terminal and a ground terminal, the contact surface for the plug terminal being provided on a first end section of the heating element and the contact surface for the ground terminal being formed on in an area of a second end section of the heating element which is located in the hollow body; wherein the hollow body is formed of a metallic material, the ground terminal being formed by contact between the heating element and the metallic material of the hollow body.

7. Glow plug according to claim 1, wherein the power supply terminals comprise a plug terminal and a ground terminal; wherein the hollow body is insulated relative to the heating element; and wherein the contact surface for the ground terminal is formed on a second end section of the heating element and is connected to a ground pole of a two-pole terminal plug, the contact surface for the plug terminal being provided on a first end section of the heating element.

8. Glow plug according to claim 1, wherein heating element is a ceramic conductor.

9. Glow plug according to claim 8, wherein the ceramic conductor has areas which have been at least partially differently doped, so that areas with positive and negative temperature coefficients of resistance are formed.

10. Glow plug according to claim 9, wherein the contact surfaces of the heating element are pressure-applied onto the power supply terminals.

11. Glow plug according to claim 10, wherein an insulating and sealing ring is located in a second end of the hollow body that is opposite said first end and an edge of the hollow body having been crimped on to the insulating and sealing ring in a manner creating a prestress in an axial direction which applies pressure at the contact surfaces.

12. Glow plug according to claim 10, wherein the hollow body has been heated and axial upset in a manner creating an axial prestress which places contact surfaces under pressure.

13. Glow plug according to claim 9, wherein metallic contact surfaces are provided at contact points between the contact surfaces of heating element and the power supply terminals.

14. Glow plug according to claim 9, wherein the power supply terminals comprise a plug terminal and a ground terminal, the contact surface for the plug terminal being provided on a first end section of the heating element and the contact surface for the ground terminal being formed on in an area of a second end section of the heating element which is located in the hollow body; wherein the hollow body is formed of a metallic material, the ground terminal being formed by contact between the heating element and the metallic material of the hollow body.

15. Glow plug according to claim 9, wherein the power supply terminals comprise a plug terminal and a ground terminal; wherein the hollow body is insulated relative to the heating element; and wherein the contact surface for the ground terminal is formed on a second end section of the heating element and is connected to a ground pole of a two-pole terminal plug, the contact surface for the plug terminal being provided on a first end section of the heating element.

16. Glow plug according to claim 1, wherein the heating element is a heating spiral made of metallic resistance material.

17. Glow plug according to claim 16, wherein an insulating and sealing ring is located in a second end of the hollow body that is opposite said first end and an edge of the hollow body having been crimped on to the insulating and sealing ring in a manner creating a prestress in an axial direction which applies pressure at the contact surfaces.

18. Glow plug according to claim 16, wherein metallic contact surfaces are provided at contact points between the contact surfaces of heating element and the power supply terminals.

19. Glow plug according to claim 16, wherein the power supply terminals comprise a plug terminal and a ground terminal, the contact surface for the plug terminal being provided on a first end section of the heating element and the contact surface for the ground terminal being formed on in an area of a second end section of the heating element which is located in the hollow body; wherein the hollow body is formed a metallic material, the ground terminal being formed by contact between the heating element and the metallic material of the hollow body.

* * * * *